United States Patent [19]

Kelsey

[11] 3,938,363

[45] Feb. 17, 1976

[54] FORMING METAL PLATE

[75] Inventor: Ronald A. Kelsey, New Kensington, Pa.

[73] Assignee: Aluminum Company of America, Pittsburgh, Pa.

[22] Filed: Nov. 9, 1973

[21] Appl. No.: 414,381

[52] U.S. Cl. ..... 72/364; 148/131

[51] Int. Cl.[2] ..... B21D 11/00

[58] Field of Search ..... 72/364, 701; 148/130, 131, 148/11.5 A

[56] References Cited

UNITED STATES PATENTS

| | | | |
|---|---|---|---|
| 663,156 | 12/1900 | Budke | 72/364 |
| 2,726,972 | 12/1955 | Corral | 148/11.5 |
| 2,726,973 | 12/1955 | Corral | 148/11.5 |
| 3,025,905 | 3/1962 | Haerr | 72/364 |
| 3,189,337 | 6/1965 | North | 266/2.5 |

*Primary Examiner*—Lowell A. Larson
*Attorney, Agent, or Firm*—Daniel A. Sullivan, Jr.

[57] ABSTRACT

A metal forming method comprising the steps of heating of metal plate to a temperature below the temperature at which grain boundary melting occurs, placing the plate on a bottom refractory-compound die of temperature lower than plate temperature, lowering a top refractory-compound die of temperature lower than plate temperature onto the plate, the temperature of the plate when the top die first contacts it in the step of lowering being at least high enough to maintain springback at less than ⅛-inch in 25-feet if the plate were allowed after being formed to cool naturally between the dies to 125°F, the top die having sufficient weight such that the plate is deformed to conform to the dies in the step of lowering, the weight of the top die bearing on the plate, after it has conformed to the dies, with a pressure up to 100 pounds per square inch, leaving the plate between the dies until the plate time and temperature history following the lowering of the top die is such that a springback of less than ⅛-inch in 25-feet is experienced on opening the dies, and then opening the dies for removal of the plate.

5 Claims, 5 Drawing Figures

FORMING METAL PLATE

BACKGROUND OF THE INVENTION

The present invention relates to a method of hot-forming metal plate, more particularly aluminum plate.

As one means of supplying more fuel to points of consumption throughout the world, it is planned to transport liquified natural gas (LNG) in ocean going vessels. One type of storage tank for liquified natural gas is a sphere having a diameter of 120 feet. Such tanks would be contained within suitable ocean going vessels. See, for example, British Pat. Nos. 1,317,939 and 1,317,940 issued May 23, 1973 to A/S Kvaerner Brug and Moss-Rosenberg Verft A/S.

In order to make 120-foot diameter tanks capable of holding liquified natural gas, it is desired to manufacture a multitude of sphere sections which will then be welded together. In order to weld as little as possible, it is advantageous to make the spherical sections, called "orange peels", as large as possible.

SUMMARY OF THE INVENTION

It is an object of the present invention to provide a new and improved method of hot-forming metal plate, which method is especially suitable for the manufacture of large sphere sections of LNG tanks.

Another object is to provide such a method having the further advantage that no press, e.g. hydraulic press or screw-driven press, is required to effect the forming.

These, as well as other objects which will become apparent in the discussion which follows, are achieved according to the present invention by a metal forming method including the steps of heating a metal plate to a temperature below the temperature at which grain boundary melting occurs, placing the plate on a bottom refractory-compound die of temperature lower than plate temperature, lowering a top refractory-compound die of temperature lower than plate temperature onto the plate, the temperature of the plate when the top die first contacts it in the step of lowering being at least high enough to maintain springback at less than ⅛-inch in 25-feet if the plate were allowed after being formed to cool naturally between the dies to 125°F, the top die having sufficient weight such that the plate is deformed to conform to the dies in the step of lowering, the weight of the top die bearing on the plate, after it has conformed to the dies, with a pressure up to 100 pounds per square inch, leaving the plate between the dies until the plate time and temperature history following the lowering of the top die is such that a springback of less than ⅛-inch in 25-feet is experienced on opening the dies, and then opening the dies for removal of the plate.

GENERAL ASPECTS OF THE INVENTION

In carrying out the method of the present invention, first attention must be paid to the selection of a proper temperature to which the plate is to be heated before its actual forming. The plate to be formed can be heated to forming temperature while already sitting on the bottom refractory-compound die. However, the plate may also be heated to temperature in a furnace, followed by transfer of the heated plate from the furnace onto the bottom die. During such transfer, the plate temperature decreases and this decrease must be considered in choosing the maximum temperature to which the plate is heated in the furnace. In any event, the highest temperature to which the plate is brought is below the temperature at which grain boundary melting occurs. In general, a plate which has undergone grain boundary melting will exhibit, when returned to room temperature, a reduced toughness, perhaps a reduced strength, and possibly corrosion problems, this deterioration in properties resulting from the cast structure which becomes incorporated into the alloy following grain boundary melting.

Besides there being a need to pay attention to maximum temperature in the process of the invention, it is also important that the plate temperature, when the top die first contacts the plate to form it into conformation between the top and lower dies, be sufficiently high such that negligible springback be experienced when the dies are finally opened. Thus, it has been discovered that if forming is done at too low a temperature, then it is impossible to avoid springback in the finished product. The temperature of the plate when the top die first contacts it in the step of lowering is appropriate, if it is at least high enough to maintain springback at less than ⅛-inch in 25-feet when the plate is allowed to cool naturally between the dies to 125°F.

The portions of the dies which actually bear against the metal plate being formed according to the present invention are made of a refractory compound, for example one of the calcium aluminate cements. H-W ES Castable of the Harbison-Walker Refractories Company, Pittsburgh, Pennsylvania, is an example of a castable calcium aluminate cement which has been applied successfully in the present invention. H-W ES Castable is discussed in more detail in connection with Example I below. Another castable which has been used successfully is Visil Castable, also a product of Harbison-Walker Refractories Company. Visil Castable is a mixture of silica aggregate and hydraulic binder and exhibits on analysis essentially 71% silica, 17% alumina, and 11% lime, where percentages are on a weight basis. Maximum service temperature of Visil under cyclic conditions is 2000°F; thermal expansion is negligible up to 1500°F; resistance to thermal shock is excellent for processing aluminum alloys according to the present invention. Visil flows smoothly and does not require much tamping or vibrating to set up free of voids.

A characterizing feature of the method of the present invention is that the top die bears on the plate, after it has conformed to the dies, with a pressure only up to 100 pounds per square inch. In spite of this small pressure, the temperature required for the plate at the time it is first contacted by the top die is so high that there is no noticeable slowing down of the descent of the top die during the step of lowering when the plate is being formed to conform to the dies.

While the minimum temperature, at which the plate must be when the top die first contacts it, is determined according to a test requiring that the plate, after being formed, cool naturally between the dies to 125°F, it is ordinarily feasible to choose a temperature higher than this minimum temperature, so that the plate may be removed from the dies after being subjected to a time less than that which would correspond to natural cooling to 125°F and yet a springback of less than ⅛-inch in 25-feet is obtained. Additionally, it is possible to choose a temperature higher than the minimum temperature and then circulate coolant through the dies to shorten time and temperature history and yet obtain a springback of less than ⅛-inch in 25-feet.

The present invention is applicable to a wide range of metals and in particular to the copper-free 7xxx (e.g. 7005), 5xxx, 3xxx and 1xxx series aluminum alloys. In the case of aluminum alloy plate containing 4.4 to 10% magnesium, the teachings of U.S. Pat. No. 3,708,352 patented Jan. 2, 1973, in the names of Robert H. Brown, Melvin H. Brown, and Murray Byron Shumaker for "Strain Hardened Aluminum-Magnesium Alloys" regarding cooling rates may be applied for obtaining improved corrosion resistance.

Besides being applicable for the forming of plate at thicknesses of, for example, 1-inch and more, for example up to 3-inches, into spherical sections for use in making LNG tanks, the method of the present invention also is applicable for the forming of boat hull sections out of plate of, for example, 3/16-inch thickness.

DESCRIPTION OF THE PREFERRED EMBODIMENTS

Figure 1:
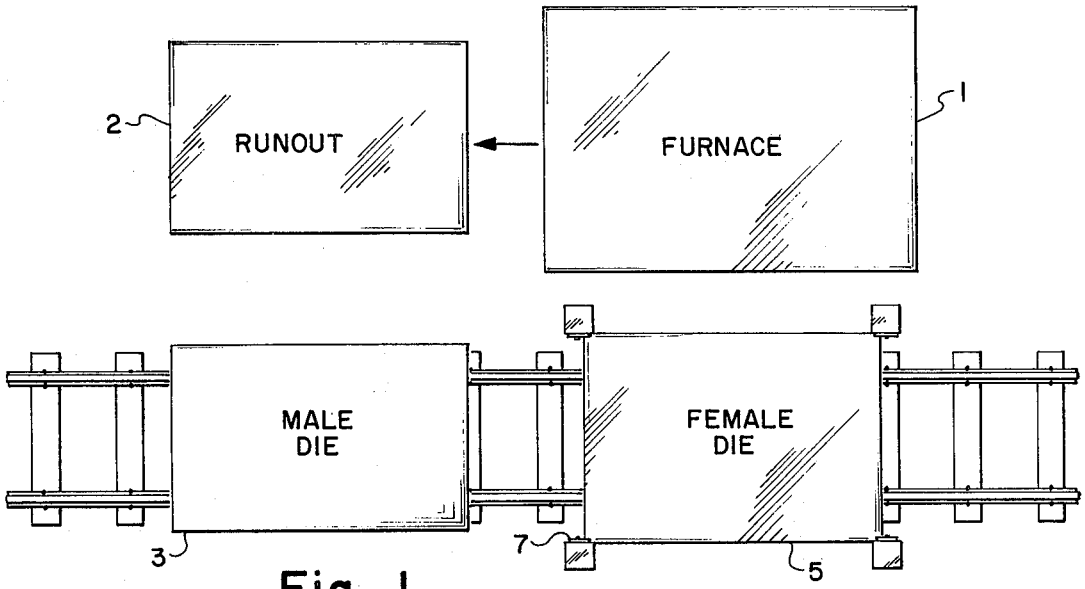
FIG. 1 is a schematic, plan view of a station for carrying out the method of the invention.
Figure 2:
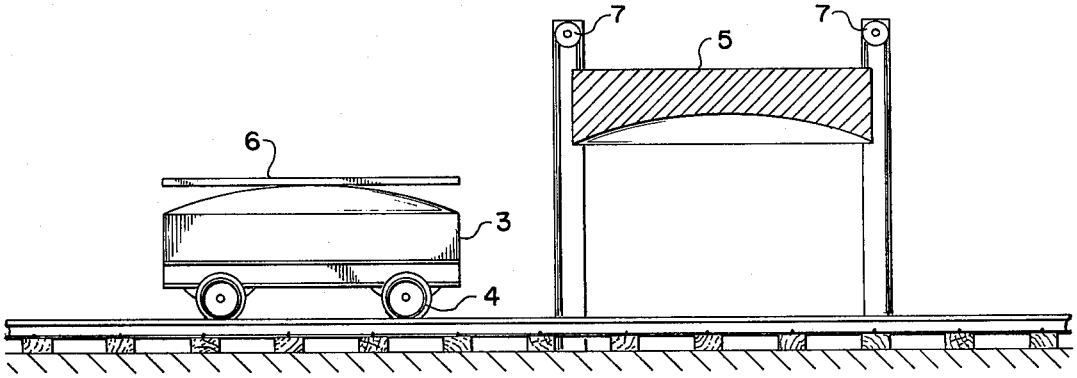
FIG. 2 is a schematic, elevational view of a portion of the station of FIG. 1.

FIG. 1 illustrates a possible station floor plan for equipment useful for carrying out the present invention. The two dies of FIG. 1 are shown in elevation in FIG. 2. In carrying out a preferred method of the present invention, as-rolled plate of aluminum alloy type 5083 (temper designation F) is placed in furnace 1 at a maximum soaking temperature not to exceed 930°F. Heat-up rate is in general, from room temperature to soaking temperature, 1 hour per inch of plate thickness. Maximum time at temperature is from zero to 8 hours and will usually not exceed 1 hour, with a ½ hour soak time generally being aimed for.

After an appropriate soak, the plate is moved into the run-out area 2, where it is picked up using a vacuum cup hoist such as that disclosed in the application of Richard B. Weiss and D. Marshall Fox, filed Nov. 1, 1973, and entitled "Vacuum Lifter". The plate is moved with the hoist over the top of the male die 3. A sufficient number of vacuum cups are used so that no sharp, local kinks or bends are introduced into the hot plate. The plate is then lowered onto the male die.

The male die is provided with rollers 4 so that it can be pushed below the female die 5. When the plate 6 and male die 3 are below the female die, the female die is lowered using hoist 7. The heavy weight of the female die causes forming to take place without noticeably interrupting the downward descent of the female die. The female die moves downwardly at a velocity of 1 to 2 inches per second. Preferably, the weight of the upper, in this case female, die is sufficient to provide an average pressure of at least 550 pounds per square foot on the plate when conformed to the dies.

The plate temperature should not be lower than 800°F when the female die is lowered into position on the male die. The plate is left between the dies until the plate temperature reaches 400°F.

Figure 3:
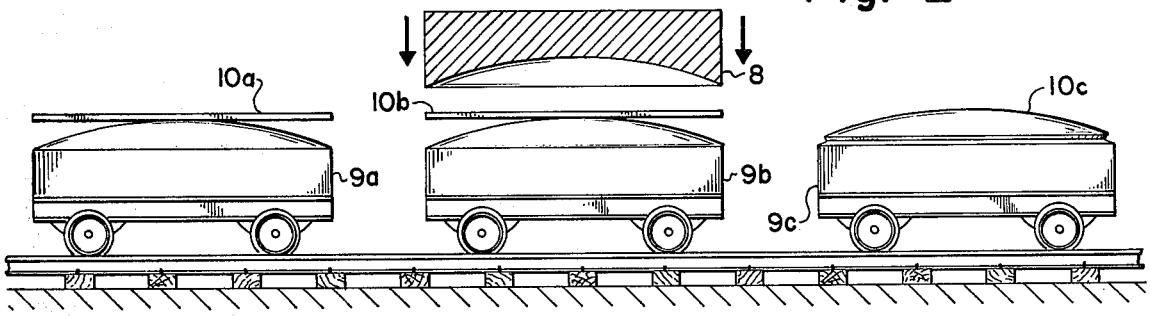
FIG. 3 is a schematic, elevational view of an alternate station for carrying out the method of the invention.

Referring now to FIG. 3, operation of the method of the invention is illustrated using a single female die 8 and a number of male dies 9*a*, 9*b*, 9*c*. The plate 10*a* on male die 9*a* has not yet been formed; the same is true of plate 10*b*. Plate 10*c* in contrast has already been formed and may now be removed for further processing.

Figure 4:
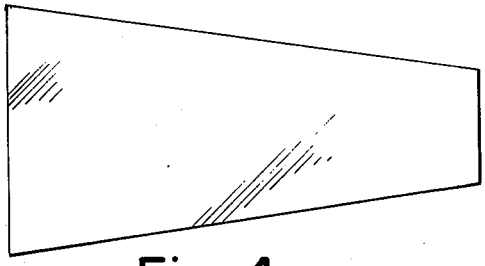
FIG. 4 is a plan view of a plate formable according to the present invention.

FIG. 4 illustrates a typical shape of plate used in making orange-peel spherical sections.

Figure 5:
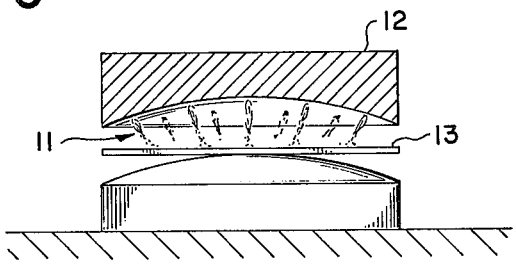
FIG. 5 is a schematic, elevational view of another, alternate station for carrying out the method of the invention.

FIG. 5 illustrates an alternate embodiment where flame jets 11 in the female die 12 are directed onto plate 13 for the purpose of bringing the plate up to the desired hot-forming temperature. When the plate has reached the desired temperature, the female die is lowered and forming takes place. Radiant heating is an alternative for the flames used in this embodiment.

In general, for the processing of metals which are not amenable to hardening by heat treatment, e.g. aluminum alloy type 5083, it is preferred that process parameters be chosen as much as possible for minimizing recrystallization, in order to maintain strength at the highest possible levels.

Further illustrative of the present invention are the following examples:

EXAMPLE I

A. THE DIES

1. Lower Die Construction

The lower die was the male die. It had a rectangular outline in the horizontal and an eggcrate-style framework of ¾ inch steel plates. The approximate overall dimensions of the male die were 17 feet in width, 50 feet in length, and 8 feet in height. The die weighed 104 tons when finished. The longitudinal ribs were slotted from their top sides halfway down and the cross plates were slotted from their bottom sides halfway up. The slotting of the longitudinal ribs was approximately at 5 foot intervals, while the slotting of the cross plates was approximately at 4 foot intervals. Upon assembly by lowering the longitudinal ribs onto the cross plates with the slots appropriately aligned to obtain an eggcrate assembly, the longitudinal ribs formed, with the cross plates, cells of rectangular cross section in the horizontal having dimensions approximately equal to 4 feet by 5 feet. Into each of the cells was welded a bottom plate at a depth of approximately 1 foot down into the cells. The purpose of these plates was to avoid unnecessary consumption of refractory compound. A pole was provided at the very center of the die extending downwards to the bottom of the die. This allowed for the mounting of a turn post from which extended a screed whose lower surface coincided with a portion of a great circle corresponding to the inner diameter, 100 feet in this Example, of the sphere whose orange peel segments were to be produced using the particular male die in question. The screed was arranged so that the upper surface of an approximately 12 inch thick, castable, high temperature refractory would extend 2 inches beyond the upper surfaces of the longitudinal ribs and cross plates. Castable refractory, e.g. H-W ES Castable available from the Harbison-Walker Refractories Company of Pittsburgh, Pennsylvania, was poured into the individual cells and the screed used to form the upper surface of the die to the desired spherical radius. The screeding procedure was similar to that disclosed in U.S. Pat. No. 3,030,259 issued Apr. 17, 1962, to F. V. Long for a "Method of Fabricating Precision Formed Plastic Products", except: 1) that the lower end of the screed is supported in the present case by screed guide plates pre-sawed to the necessary contour and attached to protrude above the longitudinal ribs and cross plate on the outer perimeter of the die; and 2) that the turn post and pole are mounted to the eggcrate assembly rather than to a slab. Refractory clips welded to the steel eggcrate frame acted to anchor the refractory to the frame. Refractory clips are small wire reinforcements that take hold of the refractory and tie it into the structure. Cooling pipes were cast into the refractory to provide the possibility for increasing the rate of heat extraction from the die, either during a forming process or after one has been completed and before another starts.

Concerning H-W ES Castable in further detail, it is made from calcium aluminate and fire clay and has a composition essentially of, in percent by weight, 39% silica, 40% alumina, 13% lime, 5% iron oxide ($Fe_2O_3$), and 1% titania. H-W ES Castable conforms to ASTM classification C 401-68 Class A and B. It has a maximum service temperature of 2400°F, 121 pounds of it, as measured dry, are required to provide one cubic foot of cast material, 10¾ to 2 U.S. gallons of water are required per 100 pounds of it dry to prepare it for pouring, and it has a bulk density, after drying at 230°F, of 130 pounds per cubic foot. It has a modulus of rupture, after drying at 230°F, equal to 900 to 1200 pounds per square inch; after heating at 1000°F, 500 to 700 pounds per square inch; after heating at 1500°F, 500 to 700 pounds per square inch; after heating at 2300°F, 400 to 700 pounds per square inch. Its cold crushing strength, after drying at 230°F, is 4100 to 6500 pounds per square inch; after heating at 1000°F, 3500 to 5000 pounds per square inch; afer heating at 1500°F, 3100 to 4500 pounds per square inch; and after heating at 2300°F, 2500 to 3300 pounds per square inch. Its linear change in percent, after drying at 230°F, is negligible; after heating at 1000°F, 0 to −0.2; after heating at 1500°F, 0 to −0.3; and after heating at 2300°F, +0.1 to −1.0.

2. Upper Die Construction

The upper die was the female die and was of the same general construction and overall width and length as the lower die. Its overall height was about 10 feet and its finished weight was 119 tons. In order to form the bottom, female surface, the lower, male die is used as a mold. The lower die surface is covered with a rubber sheet having a thickness essentially the same as that of plates to be formed between the dies. The upper die is placed on the top of the rubber sheet and castable refractory is then poured into the eggcrate cells through the top. The rubber sheet then forms the lower or matching surface of the female die. The refractory is anchored to the eggcrate frame again with refractory clips. Cooling pipes are also cast into the refractory to provide added heat extraction potential.

B. THE DIES IN USE

Aluminum alloy type 5083 ingot of composition, in weight percent, silicon 0.09, iron 0.22, copper 0.06, manganese 0.72, magnesium 4.80, chromium 0.09, zinc 0.05, titanium 0.04, balance aluminum, was presoaked for a minimum of 4 hours at a metal temperature of 850° to 920°F. The ingot was then hot rolled, using a temperature of 860°F as the starting temperature before rolling, to plate material of thickness equals 1.433 ± 0.050 inches, width of 191 inches, and length of 400 inches. This plate was sawed to a shape as illustrated in FIG. 4, with the narrow end being 87 inches, the wide end being 170 inches, and length being 340 inches. The shaped plate of F-temper and conforming to ASME SB-209 "Specification for Aluminum-Alloy Sheet and Plate" except as otherwise noted herein was then introduced into a furnace maintained at 920°F. It took the plate 1 hour and 15 minutes to heat up to furnace temperature. After 15 minutes of soak at temperature, the plate was pulled for forming. The heated plate was placed on the male die, and, before the plate temperature had decreased to 800°F, the female die was lowered into contact with the plate. The length of time between when the plate was taken from the furnace and when the female die first contacted the plate on the male die was two minutes, during which time the plate temperature dropped 100°F. Continued lowering of the female die conformed the plate to the 50-foot spherical radius of curvature of the dies. The plate was then left between the dies until the plate temperature cooled down to 400°F, i.e. in this instance for a time of 1 hour and 30 minutes, after which it was lifted onto a rack and allowed to air cool. No collant was actually circulated through the cooling pipes. Using standard ASTM E8 tensile specimens of ½-inch diameter, 2-inch gauge length, the formed plate exhibited, in the long transverse direction (as referred to the plate orientation during hot rolling), a tensile strength of 47 kilopounds/square inch (ksi), a yield strength of 23 ksi, and an elongation of 21%. In the longitudinal direction (again as referred to the plate orientation during hot rolling), the plate exhibited a tensile strength of 46 ksi, a yield strength of 23 ksi, and an elongation of 21%.

Example II

All parameters were the same as in Example I, except as follows. Plate thickness was 1.462 ± 0.050 inches. Preliminary to being placed on the male die, the plate of this example took 1 hour and 35 minutes to heat up to 920°F and received 45 minutes at the soak temperature of 920°F. Transfer time, from furnace to initiation of forming, was 2 minutes, during which time the plate temperature dropped 105°F. Cool-down time to 400°F was 55 minutes. Properties of the formed plate, in the long transverse direction, were 46 ksi tensile strength, 22 ksi yield strength, and 23% elongation, while for the longitudinal direction, the tensile strength was 47 ksi, the yield strength 22 ksi, and elongation 23%.

Example III

Parameters were as in Example I except as follows. Plate thickness was 1.445 ± 0.050 inches. The metal was aluminum alloy type 5083 of composition, in weight-%, silicon 0.10, iron 0.13, copper 0.07, manganese 0.84, magnesium 4.90, chromium 0.10, zinc 0.03, titanium 0.02, balance aluminum. In the heating preliminary to forming the plate between the dies, the plate took 1 hour and 40 minutes to reach 920°F, and it stayed at that soak temperature for 30 minutes. Transfer time was 2 minutes, with temperature loss being 85°F. Cool-down time to 400°F was 1 hour, 18 minutes. The formed plate exhibited, in the long transverse direction, a tensile strength of 45 ksi, a yield strength of 22 ksi, and an elongation of 22%. For the longitudinal direction, tensile strength was 45 ksi, yield strength 22 ksi, and elongation 23%.

Example IV

Parameters were according to Example I, except as follows. Plate thickness was 1.445 ± 0.050 inch. The metal was aluminum alloy type 5083 of composition, in weight-%, silicon 0.11, iron 0.16, copper 0.06, manganese 0.83, magnesium 4.77, chromium 0.10, zinc 0.05, titanium 0.02, balance aluminum. This plate took 2 hours to heat up to 920°F and was kept at that soak temperature for 55 minutes. Transfer time was 2 minutes, with temperature loss during that time amounting to 100°F. Cool-down time to 400°F was 48 minutes. Properties obtained in the formed plate were, in the long transverse direction, 46 ksi tensile strength; 22 ksi yield strength, and 22% elongation. For the longitudinal direction, tensile strength was 45 ksi, yield strength was 22 ksi, and elongation 23%.

Example V

Using the dies as described in Example I, a plate, tapering in thickness in the direction of rolling, i.e. the longitudinal direction, from 3 inches down to 1-½ inches over a distance of 90 inches (as measured in the longitudinal direction) and then having a constant 1-½ inch thickness over the remainder of its length, was formed to spherical curvature while yet exhibiting no buckling in the finished product. Total length of the plate was 350 inches and its width was 194 inches. Furnace temperature in the heating preliminary to forming was 925°F. Initial contact of the female die with the plate was at a temperature between 800° and 825°F. The female die had sufficient freedom to cock in order to accommodate the 3 inch thickness at the one end of the plate. Plate thickness remained essentially unchanged in the forming process, the process simply giving to the plate an internal spherical diameter corresponding to the curvature of the male die at all locations except in the vicinity of the transition between the tapered section of the plate and the uniform thickness section of the plate.

It will be understood that the above description of the present invention is susceptible to various modifications, changes, and adaptations and the same are intended to be comprehended within the meaning and range of equivalence of the appended claims.

What is claimed is:

1. A metal forming method comprising the steps of heating a metal plate to a temperature below the temperature at which grain boundary melting occurs, placing the plate on a bottom die of temperature lower than plate temperature, lowering a top die of temperature lower than plate temperature onto the plate, the temperature of the plate when the top die first contacts it in the step of lowering being at least high enough to maintain springback at less than ⅛-inch in 25-feet if the plate were allowed after being formed to cool naturally between the dies to 125°F, the top die having sufficient weight such that the plate is deformed to conform to the dies in the step of lowering, the weight of the top die bearing on the plate, after it has conformed to the dies, with a pressure up to 100 pounds per square inch, leaving the plate between the dies until the plate time and temperature history following the lowering of the top die is such that a springback of less than ⅛-inch in 25-feet is experienced on opening the dies, and then opening the dies for removal of the plate.

2. A metal forming method as claimed in claim 1, wherein said plate is of type 5083 aluminum alloy, the temperature of the plate when the top die first contacts it in the step of lowering is at least 800°F, and the plate is left between the dies until the plate temperature reaches 400°F.

3. A metal forming method as claimed in claim 1, said dies being shaped to form said plate to a section of a sphere.

4. A metal forming method as claimed in claim 1, wherein the plate thickness is at least 1 inch.

5. A metal forming method as claimed in claim 1, wherein the top and bottom dies are refractory-compound dies.

* * * * *

UNITED STATES PATENT AND TRADEMARK OFFICE

CERTIFICATE OF CORRECTION

PATENT NO. : 3,938,363

DATED : February 17, 1976

INVENTOR(S) : Ronald A. Kelsey

It is certified that error appears in the above-identified patent and that said Letters Patent are hereby corrected as shown below:

| | |
|---|---|
| Col. 5, line 4 | Change "plate" to --plates--. |
| Col. 5, line 24 | Change "103/4" to --1-3/4--. |
| Col. 6, line 24 | Change "collant" to --coolant--. |

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*